US011105517B2

(12) United States Patent
Marcucci

(10) Patent No.: US 11,105,517 B2
(45) **Date of Patent: *Aug. 31, 2021**

(54) INTERIOR SPACE COOLING DEVICE, SYSTEM AND METHOD OF USE

(71) Applicant: Lisa Marcucci, Mechanicsburg, PA (US)

(72) Inventor: Lisa Marcucci, Mechanicsburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/122,657

(22) Filed: Dec. 15, 2020

(65) Prior Publication Data

US 2021/0180803 A1 Jun. 17, 2021

Related U.S. Application Data

(60) Provisional application No. 62/948,617, filed on Dec. 16, 2019.

(51) Int. Cl.

| | |
|---|---|
| ***F24F 1/02*** | (2019.01) |
| ***F24F 13/062*** | (2006.01) |
| *F24F 13/06* | (2006.01) |
| *F24F 7/00* | (2021.01) |

(52) U.S. Cl.
CPC ..... *F24F 1/02* (2013.01); *F24F 13/062* (2013.01); *F24F 2007/004* (2013.01); *F24F 2013/0612* (2013.01)

(58) Field of Classification Search
CPC ..... B60H 1/0025; B60H 1/00295; B60H 1/3204; B60H 2001/003; F24F 1/02; F24F 13/062; F24F 2007/004; F24F 2013/0612
USPC ..... 454/69, 116, 370, 284
See application file for complete search history.

(56) References Cited

U.S. PATENT DOCUMENTS

| | | | | |
|---|---|---|---|---|
| 2,601,663 | A * | 6/1952 | Lamb | B63H 21/34 454/2 |
| 4,993,314 | A * | 2/1991 | Braden | B63G 13/02 110/184 |
| 5,562,155 | A * | 10/1996 | Blumberg | B65D 88/74 165/128 |
| 5,636,993 | A | 6/1997 | Badry | |
| 6,158,175 | A * | 12/2000 | Carter | F24F 1/58 52/23 |
| 6,623,353 | B1 | 9/2003 | Akhtar | |
| 8,016,651 | B2 | 9/2011 | Mangiapane | |
| 8,746,929 | B2 * | 6/2014 | Budai | F21V 33/00 362/253 |
| 10,807,435 | B1 | 10/2020 | Marcucci | |
| 2006/0109658 | A1 * | 5/2006 | Chou | F21V 1/06 362/351 |
| 2014/0362563 | A1 * | 12/2014 | Zimmerman | F21S 8/026 362/147 |
| 2017/0316133 | A1 | 11/2017 | Abramov | |
| 2018/0266395 | A1 | 9/2018 | Abramov | |

FOREIGN PATENT DOCUMENTS

| | | |
|---|---|---|
| CN | 102975590 A | 3/2013 |
| CN | 202834018 U | 3/2013 |

* cited by examiner

*Primary Examiner* — Kenneth J Hansen
*Assistant Examiner* — Dana K Tighe
(74) *Attorney, Agent, or Firm* — William Gray Mitchell

(57) ABSTRACT

The invention is a device, system and method of use for cooling the temperature in an interior space without the need for a power source or moving parts.

14 Claims, 3 Drawing Sheets

INTERIOR SPACE COOLING DEVICE, SYSTEM AND METHOD OF USE

CROSS REFERENCE TO RELATED APPLICATIONS

Figure 1:
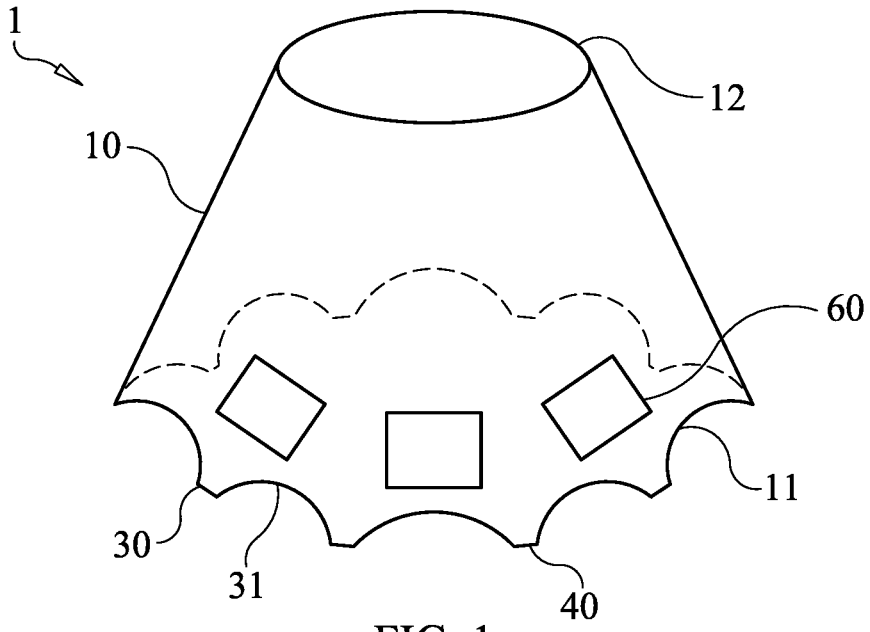

Not applicable.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is a device and system for cooling the temperature of any interior space without requiring a power source or moving parts, as well as a method of using such device.

DETAILED DESCRIPTION OF THE INVENTION

The invention constitutes a system made up of one or more individual funnel-shaped cooling units of varying sizes that can be placed on both horizontal and vertical surfaces inside of a room or interior space, with large openings facing down and small openings facing up. The system's efficiency improves when individual units are positioned in areas that are known to warm rapidly under radiant heat, such as inside of windows and skylights. In a preferred embodiment, such funnel units will be placed inside of a box or similar outer shell. Such box or shell can then be placed in a room or throughout a structure by hanging on walls, placement on floors, tables or counters, or by more permanent fixation. In an alternate embodiment, the funnel unit comprises a bottle shape, with a larger barrel aspect for the large opening and a bottle neck element for the small opening.

For interior room placement, vertical structure on or near walls is likely to be a preferred design. To avoid cooled air emanating from a given funnel unit being blown directly into the intake of a second funnel unit, a preferred design will stagger the placement of the funnel units inside a box or shell in a stairstep or similar pattern. In such design, the shell will ideally be either bracket-shaped, with three sides surrounding and shielding the funnel units, or comprising four walls fully surrounding the funnels. In either event, the shell must be open on the top and bottom to allow for the intake of room air and expulsion of cooled air. In either a three-sided or four-sided configuration, the shell will ideally comprise a means of semipermanent adhesion to a wall or similar surface, such as Velcro tape or a similar means.

For funnel units placed on horizontal surfaces, the large opening of each unit must comprise a series of interspersed spacers and air openings, such that the funnel unit will be able to intake the warm air below as it rises. These spacers and openings will not be required for units attached to vertical surfaces.

According to the Venturi effect, a known volume of air traversing through a progressively smaller cross-sectional area must undergo compression and an increased flow rate. According to Bernoulli's principle, an increase in the flow rate of a fluid (e.g., air) must be accompanied by a decrease in the fluid's potential energy, which results in decreased temperature. Thus, the air passing through the funnel unit will be compressed and have its flow rate increased, such that the air exiting the unit through its upper small opening will be cooler than the air entering the lower large opening, known as the Joule-Thomsen effect. In an alternate embodiment, the larger opening may be an unbroken rim with air intake holes cut or drilled above such rim.

Depending on the thermodynamics of the adjacent environment, the air taken in and cooled will either descend or keep rising, albeit at a slower rate. Regardless of which direction the just-cooled air moves, a micro convection current will occur in the adjacent area, which will cause additional cooling. This flow pattern is continuous while the device is in place and pulls more outside air into the large opening, thus working on a positive feedback basis to constantly draw warmer air from the interior space into the device.

Optionally, one or more high heat capacitance units will be arranged on the interior surface of a funnel unit at or near the large opening, which material will act as a capacitor in a standard air conditioner, without requiring a dedicated power source, thus enhancing the volume of warm air entering the large opening. This high heat capacitance material will assist in creating a heat sink and additional convection air currents to draw hot air into the funnel, thus further increasing the cooling efficiency of the unit.

Funnel units will preferably be made of plastic of a type from the group including, but not limited to, high-density polyethylene, low-density polyethylene, copolyester or polypropylene. Alternative materials may include, paper or cardboard, glass, ceramic, or metal. The large openings of the funnel will be approximately ⅛-½ of an inch, preferably ⅝ inches, off of the surface on which it rests, and will be spaced far enough apart that any direct sunlight will predominantly hit the surface and not the device. Preferred diameters for the large opening will be in the range of 2 inches to 4 inches, and the small opening from ¼ inch to two inches, although larger or smaller iterations are possible. The preferred ratio of large opening to small opening is, without limitation in the range of 3:1 to 5:1.

The use of highly flexible or foldable materials such as cardboard will also allow for an optional folding feature in both the funnels and any box or other decorative container. In such a design, each funnel could be foldable as with a funnel-style coffee filter and can be opened for use. A plurality of such foldable funnels could be arranged inside a similarly foldable shell, either three- or four-sided, so that the entire unit can be optionally and repeatedly opened for use and closed for deactivation and/or storage.

The funnel units to be seated on horizontal surfaces may ideally be placed on inner window sills or otherwise near windows. Multiple units may be set into a flexible lattice that will allow it to be placed on the top of the sill or other surface. The openings in such lattice base will allow the funnel unit to intake air without the incorporation of air openings in the funnel itself. Ideally, the lattice base will comprise neoprene or similar heat-resistant covers, thereby protecting the funnel rim from any hot surface, while also decreasing the temperature of air entering the funnel. The funnels will also optionally have multiple pieces of high heat capacitance material adhered to the inner surface of the funnel. In a preferred embodiment, such funnel units for horizontal placement also will be covered in a dark cover but will lack the packaging material and neoprene components of the vertical units.

The latticework base will be darkly colored, and preferably neoprene-covered, and will be supported by rigid vertical struts so that placing an object on the structure will not deform or crush it. In one embodiment, either the base unit is made of a high heat capacitance material such as wood, hemp, or metal, or high heat capacitance units will be arranged within the latticework of the base structure as well as within the funnel units themselves. Flexible strut connectors will be used to allow the base to overlay an irregular surface. Additional flexible connectors will connect the upper portion of each strut to one or two funnel units interspersed between the pairs of struts, such that the funnel units will hang over a horizontal surface without touching it, thereby preventing the funnels from heating and related deformation. Rigid vertical struts may be comprised of wood, metal, or any other material suitable for appropriate weight bearing. Flexible connectors may be comprised of hemp or other flexible organic material, rubber, plastic, neoprene or other fabric, or any other material with appropriate heat resistance and flexibility. Connectors running between a given pair of vertical struts along the horizontal surface may preferably be rigid as well, to assist in maintaining verticality of the struts.

On both the funnel-shaped and bottle-shaped units, the smaller opening will be rigid and non-compressible to ensure unimpeded air flow through the unit. In one embodiment, funnel units can be manufactured using recycled plastic water bottles that require no modification other than cutting them to size. To create the heat sink, balsa wood is a highly preferred material, because of low cost, low weight, ease of cutting and for its high heat capacitance properties. Alternative high capacitance materials include but are not limited to glass, hemp or other organic material, alternate types of wood, ceramic, plastic film, paper and mica.

Once the units are positioned, the system will work 24 hours a day without moving parts or an outside energy source. The more units placed in a given room, the better the cooling capacity of the system. The units themselves require no customization and can be installed in a few minutes quickly.

In one embodiment, the inside surface of the funnel can be arranged with a pattern of beads and/or cut ridges to further harness well known thermodynamic principles previously discussed. In one iteration, the funnel is converted from a smooth surface to one that is patterned with raised ridges, much like the ridges of a ridged potato chip. In addition, these ridges would be arranged so that the opening of each depression between the ridges would have a larger orifice corresponding to the larger orifice of the funnel tapering to a smaller orifice near the top lip of the smaller orifice of the funnel.

A ridged morphology would act to facilitate cooling in several ways. First, the ridges increase surface area and will increase cooling by conduction. Secondly, the ridges act similarly to a weir in a slow-moving river, increasing turbulence of the air flow and thus increasing convection cooling. Finally, the placement of ridges on the inner surface of the funnels will act to entrap transmit discreet jets of rising air. If viewed in cross-section the peak-valley-peak morphology of the ridges approximates a partial circumference of a tube, thus producing on a partial basis the same increase in air velocity, compression of air, and expansion of air as seen in a completely enclosed tube and funnel, based on the airflow thermodynamics described by the Venturi, Bernoulli, and Thomson-Joule effects as described above.

In another iteration, a beaded pattern is adhered to the inner surface of the funnel. The beads will be of different sizes and shapes and will be placed over the entirety of the inner surface, including at the area immediately adjacent to the larger funnel orifice and immediately adjacent to the rim of the smaller orifice. In one embodiment, the beads are comprised of a high capacitance material. Placement of beads along the path of the previously discussed ridges would create a synergetic effect by further increasing surface area inside the funnel and thus cause turbulence in the air flow through the funnel. This turbulence will increase both convection and conduction to more efficiently cool the air moving through the device.

It should be noted that any of the iterations disclosed herein may be reversed to accomplish a warming effect within an interior space.

DETAILED DESCRIPTION OF THE FIGURES

FIG. 1 shows a first embodiment of a non-powered cooling device 1 comprising a funnel unit 10 with a large opening 11 showing from the device bottom, small opening 12 as the top and optional high heat capacitance units 60 arranged inside. The large opening features spacers 30 and air openings 31 for air intake, with adhesive 40 on some or all spacers for adhesion of the funnel unit to an underlying surface (not pictured).

Figure 2:
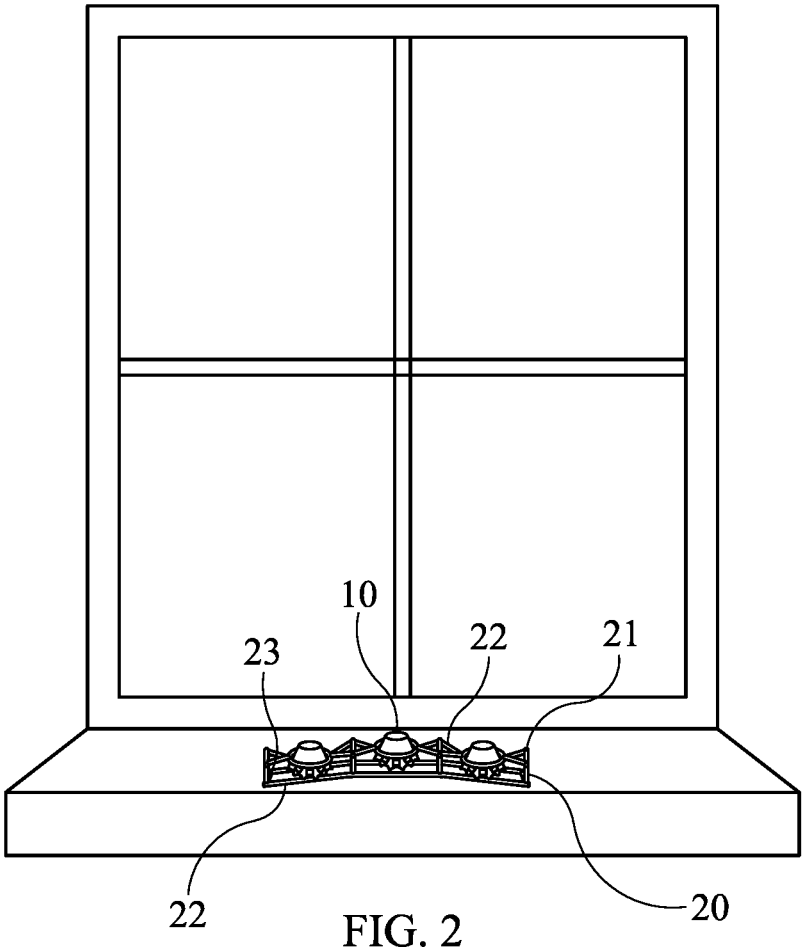

FIG. 2 shows an alternate embodiment of the device of FIG. 1, wherein a plurality of funnel units are attached to a single latticework base 20 along the top of an interior window sill. The base 20 comprises a plurality of pairs of base struts 21 raised vertically from a window sill, each such pair of struts connected by a rigid base connector 23. Each pair of struts 21 is connected to one another by two or more of flexible base connectors 23 overlaying the sill, and each set of struts is further interspersed with and connected to funnel units 10 by a plurality of flexible base-funnel connectors 24, wherein such flexible base-funnel connectors adhered or tied to the top of each strut and around each funnel unit. Each funnel unit is thus allowed to hang freely above the sill surface without touching it. This embodiment may also be employed on any horizontal surface, including but not limited to tabletops and countertops.

Figure 3:
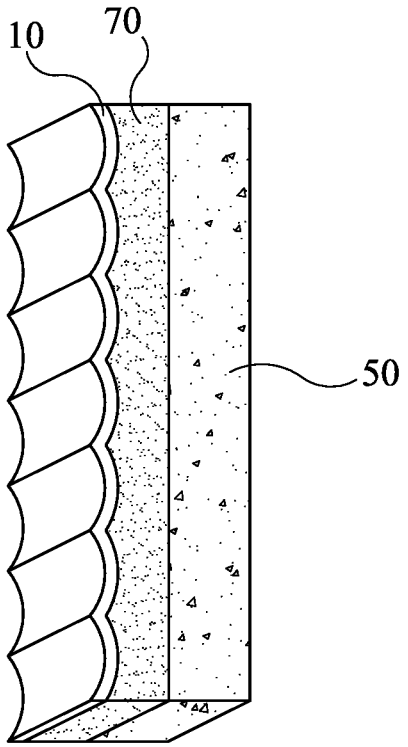

FIG. 3 shows a cutaway view of the cooling device embodiment of FIG. 2, wherein the bottle-shaped funnel unit 10 is overlaid with a layer of packing material 70, and further overlaid by a dark cover 50, such as neoprene material.

Figure 4:
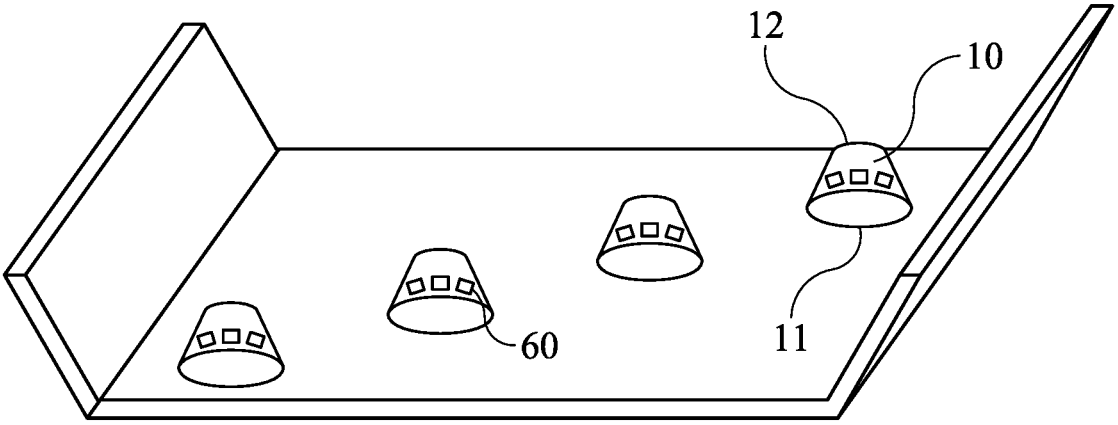

FIG. 4 shows plurality of funnel units 10, with the small openings 12 of the funnel units 10 pointing upward for air cooling. In this iteration, multiple funnel units 10 are adhered to the inner surface of shell 70 in a stairstep pattern to avoid one unit expelling cooled air from its small opening 12 directly into the large opening 11 intake of another unit. A row of optional high heat capacitance units 60 are visible circumnavigating each large opening to aid in room air intake. Various patterns of staggering units are available to maximize the user of internal surface area of the shell while avoiding cross-ventilation between units.

Figure 5:
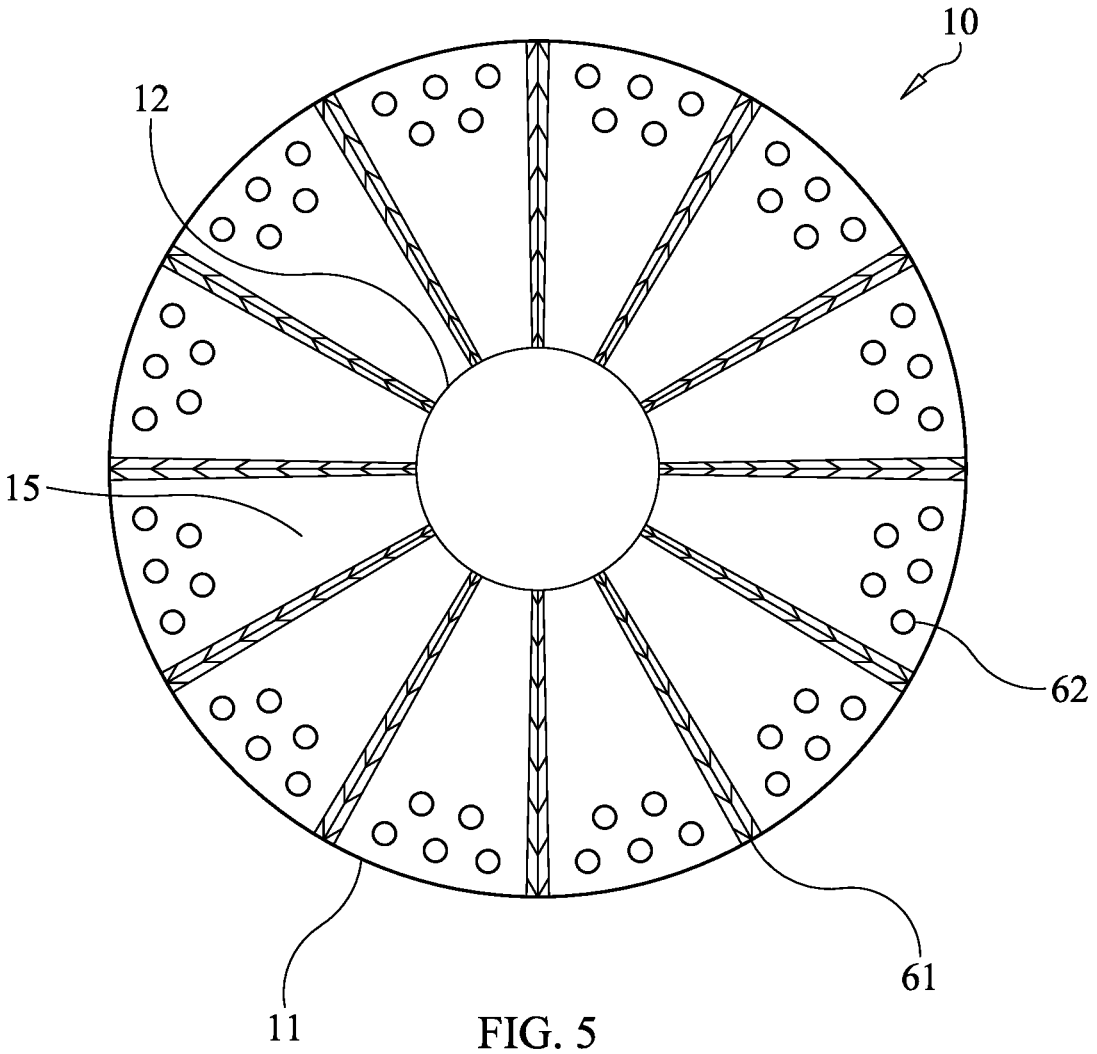

FIG. 5 shows the inner wall 15 of a funnel unit 10 comprising a ridged and beaded morphology. As shown, a plurality of raised ridges 61 run from the large opening 11 to the small opening 12 of the funnel unit, thus channeling the air running through the unit between such ridges. In this embodiment, a plurality of beads 62 are further arranged in the spaces between the raised ridges, thereby creating additional turbulence in the channeled air and thus increasing convection cooling. While the embodiment pictured shows a regularity to the placement of ridges and beads around the inner surface, such regularity is not required, and placement of the beads and ridges may appear in a multitude of patterns or haphazardly. Another embodiment may also comprise beads only or ridges only, as neither feature requires the presence of the other. Ridges and beads may optionally be formed from high capacitance materials.

Figure 6:
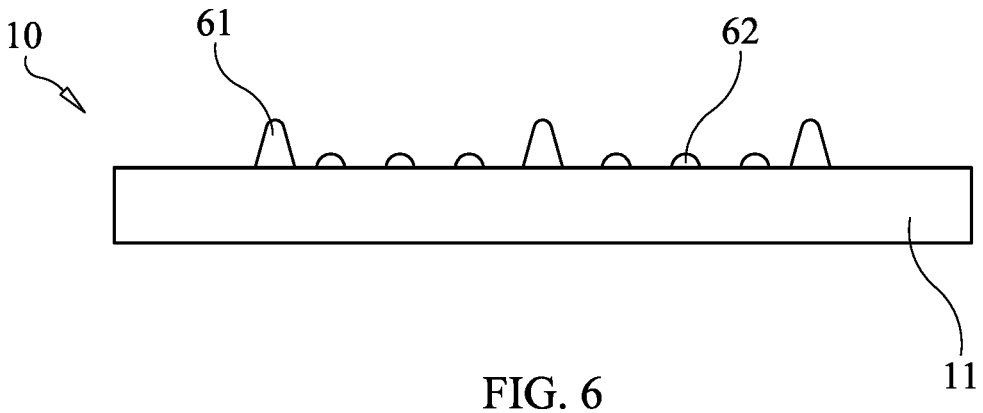

FIG. 6 shows a cross-section of a funnel unit 10 wall comprising the ridges 61 and beads 62 as pictured in FIG. 5, wherein the ridges are shaped roughly as tapered hillocks while the beads are shaped as semicircular studs. In other embodiments, the shape of the ridges and beads may be more squared or conform to alternate shaping to further maximize convection.

LIST OF REFERENCE NUMBERS

1 Cooling device
10 Funnel unit
11 Large opening
12 Small opening
13 Barrel
14 Neck
15 Inner wall
20 Base
21 Base strut
22 Flexible base connector
23 Rigid base connector
30 Spacer
31 Air opening
40 Adhesive
50 Dark cover
51 Cord loop
52 Cord
60 High heat capacitance units
61 Ridge
62 Bead
70 Shell
80 Dark Sheathing The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A cooling device, consisting of a funnel unit comprising an outer surface, an inner surface comprising a plurality of ridges running from the large opening to the small opening, a small opening and a large opening, wherein the large opening faces downward and the small opening faces upward and the funnel unit is adhered to a surface.

2. The cooling device of claim 1, wherein the outer surface of the funnel unit is a convex are.

3. The cooling device of claim 1, wherein the funnel unit is comprised of a foldable material and can be folded flat or opened into a funnel shape.

4. The cooling device of claim 1, wherein the plurality of ridges are arranged to be further apart at the large opening than at the small opening.

5. An air cooling system, comprising one or more funnel units of claim 1 adhered to an inner surface of a shell, the shell comprises an open top and an open bottom, and the shell is adhered to a wall such that the one or more funnel units are arranged partially or completely within the shell.

6. The cooling system of claim 5, wherein an outer surface of the shell is covered in a dark material.

7. The cooling system of claim 5, wherein the one or more funnel units comprise a plurality of funnel units, such plurality of funnel units arranged in a staggered pattern.

8. The cooling system of claim 7, wherein the staggered pattern is a stairstep pattern.

9. The cooling system of claim 5, wherein the one or more funnel units and the shell are foldable.

10. A method of cooling a room using the cooling system of claim 5, wherein the one or more funnel units are each adhered to the inner surface of the shell, the method comprising the following steps:

1. continuously drawing warm atmospheric air through the large opening of each funnel unit of the plurality of funnel units;
2. cooling the warm room air inside each of the funnel units of the plurality of funnel unit; then
3. exhausting cooled air through the small opening of each of the funnel units of the plurality of funnel units.

11. A cooling device, comprising a funnel unit with an outer surface, an inner surface, a small opening and a large opening, wherein the large opening faces downward and the small opening faces upward, the inner surface comprises a plurality of beads and the funnel unit is adhered to a surface.

12. The cooling device of claim 11, wherein the plurality of beads are made of a high capacitance material.

13. The cooling device of claim 11, further comprising a plurality of ridges on the inner surface.

14. The cooling device of claim 13, wherein the plurality of beads comprises a line of beads running alongside each ridge of the plurality of ridges.

* * * * *